United States Patent [19]

Sastri et al.

[11] 4,139,942

[45] Feb. 20, 1979

[54] PROCESS FOR PRODUCING CORROSION RESISTANT CARBON STEEL RAZOR BLADES AND PRODUCTS MADE THEREBY

[75] Inventors: Suri A. Sastri, Stow; Huei-Yang Chang, Braintree; Thomas G. Decker, Wellesley Hills; Richard McDonald, Scituate, all of Mass.

[73] Assignee: The Gillette Company, Boston, Mass.

[21] Appl. No.: 861,275

[22] Filed: Dec. 16, 1977

[51] Int. Cl.[2] ..... B26B 21/54; B05D 5/00

[52] U.S. Cl. ..... 30/346.54; 204/192 SP; 427/258; 427/284; 427/287; 427/333; 427/437; 427/438; 428/626; 428/667

[58] Field of Search ..... 427/284, 438, 437, 258, 427/287, 333; 30/346.53, 346.54; 76/104 R, DIG. 8; 204/38 S, 192 SP; 428/667, 626

[56] References Cited

U.S. PATENT DOCUMENTS

| | | | |
|---|---|---|---|
| 2,937,976 | 5/1960 | Granahan et al. | 427/284 X |
| 3,015,646 | 1/1962 | Speier | 260/46.5 |
| 3,345,202 | 10/1967 | Kiss et al. | 30/346.53 X |
| 3,490,314 | 1/1970 | Calnan | 76/104 |
| 3,682,795 | 8/1972 | Fischbein et al. | 428/665 X |

*Primary Examiner*—Ronald H. Smith
*Assistant Examiner*—Evan K. Lawrence
*Attorney, Agent, or Firm*—Richard A. Wise; William M. Anderson

[57] ABSTRACT

A process for producing long-lasting corrosion resistant carbon steel razor blades and the products made thereby. The process comprises first coating the cutting edges of the blades with chromium; and then immersing the blades in an electroless coating bath to provide a coating of a nickel-phosphorous, nickel- copper- phosphorous, cobalt-phosphorous or cobalt-nickel-phosphorous coating material on at least the bodies of the blades, the chromium coating preventing beading up of the coating material on the cutting edges of the blades to an extent that would require resharpening of the cutting edges. The blades may thereafter be overcoated with a carboxy-substituted silicone oil composition preferably comprising therein a long chain aliphatic acid, alcohol, amide and mixtures thereof.

10 Claims, No Drawings

PROCESS FOR PRODUCING CORROSION RESISTANT CARBON STEEL RAZOR BLADES AND PRODUCTS MADE THEREBY

BACKGROUND OF THE INVENTION

It is generally known that carbon steels have better mechanical properties for making razor blades than stainless steels. However due to their tendency to corrode, such carbon steel blades have relatively short-use lives. It is further known that their use-lives may be increased by applying chromium coatings to the edges. Generally the most efficient way to apply such chromium coatings is to stack the blades in a magazine and apply the chromium to the edges by processes such as sputtering or vapor deposition. Although such sputtering and vapor deposition processes can be effectively used on the edges they are inefficient and/or inconsistent when used on the bodies of the blades.

It is still further known from U.S. Pat. No. 3,490,314 that the bodies and edges of as-sharpened carbon steel blades can be made more corrosion resistant and longer lasting by coating them with nickel phosphorous, cobalt phosphorous or nickel-cobalt phosphorous coatings by electroless processes. Although such processes are especially effective on the bodies of the blades, there is one drawback with the edges, in that the coatings bead-up thereon causing rounding, and additional sharpening, subsequent to the coating process, is required.

SUMMARY OF THE INVENTION

One object of the present invention is to provide processes for producing razor blades which have the mechanical properties of carbon steel blades but have corrosion resistances which are comparable to those of stainless steel blades.

Another object is to produce such corrosion resistant blades by processes which are economically feasible in that no additional blade sharpening step is required.

Generally the above objects are achieved by a process which comprises coating the cutting edges of the blades with chromium by any of the well known processes, such as sputtering or vapor deposition and then immersing the blades in an electroless coating bath comprising a nickel-phosphorous, nickel-copper-phosphorous, cobalt phosphorous or cobalt-nickel-phosphorous coating material to provide a coating of the material on at least the bodies of the blades. By first coating the edges with chromium virtually none to only traces of the nickel phosphorous, nickel-copper-phosphorous, cobalt phosphorous or nickel-cobalt phosphorous coatings bead-up on the edges and subsequent sharpening of the edges is not required.

DETAILED DESCRIPTION OF THE INVENTION

In carrying out the processes of this invention the chromium coating, as pointed out above, may be applied to the edges by any of the well known methods such as, for example, sputter coating or vapor deposition. Generally sputter coating methods such as, for example, those employed in the processes disclosed in U.S. Pat. No. 3,682,795 are the most efficient and produce more consistent results on the edges.

Usually in such sputter coating processes the blades are stacked in a magazine in face-to-face relationship with their edges aligned and the magazine is placed in an evacuable chamber. Within the chamber there is an elongated chromium target which is generally positioned so as to face the edges of the blades and lie in a line with its length about parallel to the height of the stacked blades. In carrying out the processes the chamber is evacuated and the blades are generally first subjected to RF or DC cleaning in a low pressure environment of a gas, such as argon. After cleaning the chamber is evacuated and the low pressure environment of the gas, e.g. argon, is restored. With the stack of blades and chamber grounded, the chromium target is bombarded with argon ions which remove minute particles of chromium from the target and deposit them on the exposed edges of the blades.

Generally in the processes of the present invention the thickness of the chromium coating may vary. In most instances it has been found that best results are obtained when it is between about 50 to 600 angstroms in thickness and preferably between 250 and 450 angstroms.

The techniques of electroless plating are well known and are described for example in publications such as ASTM Special Technical Publication 259, printed in 1959. The plating baths generally comprise an aqueous solution containing water-soluble nickel and/or cobalt salts or nickel and copper salts, a hypophosphite to reduce the salts to the metals and a buffer. Other reagents which may be present include accelerators, inhibitors, and brighteners. Usually the plating is carried out in warm solutions, e.g. about 90° C., in which the pH is carefully controlled. The pH may be acid or alkaline for nickel but should be alkaline for cobalt. Generally the coatings comprise about 6 to 12% by weight phosphorous. As examples of commercially available electroless plating compositions mention may be made of "Enplate", the trade name for a nickel-phosphorous electroless coating composition sold by Enthone Co., West Haven, Conn., a subsidiary of American Smelting & Refining Co. and Niculoy 22, the trade name for a nickel-copper-phosphorous electroless coating composition sold by Shipley Co., Newton, Mass. Other suitable compositions may be found in "The Journal of Research of the National Bureau of Standards", Vol. 39, pages 385 to 395, 1947.

In a preferred mode of carrying out the electroless plating processes the blades are left on the magazine but the clamping mechanism is loosened so that the blades may be riffled and provide ready access to the plating solution. Generally the riffling may be brought about for example by the application of ultrasonic or jet energy to the blades. If necessary the blades may be first washed using, e.g. solvents or detergent solutions and then immersed in the plating solution. Usually the time the plating process is carried out and the thickness of the coating may vary. Quite satisfactory results were obtained when the processes were carried out for 0.25 to 5 minutes and coatings of about 1000 to 5000 angstroms were applied. Usually the longer times have to be used for the cobalt-phosphorous compositions and the shorter times may be used for the nickel or nickel alloy coatings. Generally when applying coatings of the thickness mentioned above, i.e. 1000 to 5000 Å it was found that the coating on the chromium coated edge was less than 100 angstroms and in many instances was entirely absent. Such thin coatings, i.e. less than 100 angstroms, have negligible adverse effects on the edges and don't require resharpening.

It has been found especially useful after applying the metal-phosphorous coatings to apply a carboxy-functional (i.e. a carboxy bearing) silicone oil composition such as a polydimethylsiloxane oil comprising about 1 mole % of functional carboxy groups sold by Dow Corning Co. under the trade name Dow Corning Fluid X2-7049. Generally the amount of carboxy-functional groups present may be varied. Usually the amount present will lie between about 0.5 to 1.5 mole % and preferably about 1 mole %. In preferred embodiments the silicone oil compositions will comprise a long chain (e.g. 12 to 22 carbon atoms) aliphatic compound, wherein the compound is an acid, alcohol, amide or mixtures thereof. As examples of such aliphatic materials mentioned may be made of stearic acid, stearyl alcohol and octadecyl amide. The amount of aliphatic acids, alcohols or amides added usually may vary. Generally it will lie between 1 to 10% by weight of the oil composition and preferably 5%. In applying the oil it is preferable to use a diluent or carrier such as 1,1,2-trichloro-1,2,2,-trifluoroethane. A protective solution which was found especially useful for coating the blades by dipping was one comprising 1 part of the silicone oil compositon containing 5% by weight of the aliphatic additive and 39 parts of the 1,1,2-trichloro-1,2,2-trifluoroethane.

The following non-limiting Examples illustrate the processes of the present invention:

EXAMPLE I

A magazine of commercially sharpened carbon steel blades were DC cleaned in a sputtering chamber having a 10 to 12 microns atmosphere of argon, at 1.1 amps and 1600 volts for about 5 minutes. The cleaned blades were sputter coated with chromium in a 10 to 12 micron argon atmosphere, using 3.5 K volts for 5 minutes and 20 seconds. The resulting blades having a 400Å chromium coating on the edge were dipped into an Enplate nickel-phosphorous electroless coating composition at 95° C. and a pH of 5 for 15 seconds. The coated blades were rinsed in water and in acetone and then air dried. The dried blades were then coated with a protective oil comprising 1 part by weight margaric acid, nineteen parts Dow Corning Fluid X2-7049 and 780 parts 1,1,2-trichloro-1,2,2-trifluoroethane. The blades were tested for corrosion by placing them in a gold plated razor, dipping them in water at 53° C. for 7.5 minutes, drying them in air for 7.5 minutes and repeating the cycle sixteen times. The blades after the corrosion test were relatively rust free; and were better than commercial carbon steel blades which had been lacquered. Further in a wool-felt cutting test there was substantially little difference in the force required for blades which only had the edges coated with chromium and those which were further subjected to the nickel-phosphorous coating. Such a slight change in the force indicates that there was little beading-up of the nickel-phosphorous coating on the edge.

EXAMPLE II

Commercially sharpened carbon steel razor blades which were coated with a 400 Å chromium coating in a manner similar to that employed in Example I were dipped into a Niculoy 22 nickel-copper-phosphorous plating bath at 90°-95° C. for 15 seconds. After plating, the blades were washed, dried and overcoated in a manner similar to that used in Example I. As in Example I, the blades were substantially free of rust after the corrosion test and there was substantially little change in the wool-felt forces of the chromium coated blades and those which were further coated with the nickel-copper-phosphorous coating.

EXAMPLE III

Carbon steel blades having chromium coated edges as in Example I were dipped in a coating composition containing the following ingredients per liter: 30 gms. of cobalt chloride hexahydrate, 20 gms. of sodium hypophosphite, 200 gms. Rochelle salts and 50 gms. of Amonium chloride. The pH of the composition was adjusted to 9, the composition was heated to 100° C. and the blades were immersed in it for about 5 minutes. The blades were washed and dried and divided into 4 groups. One group was covered with an oil as used in Example I except that the margaric acid was replaced with stearic acid; a second group was coated with an oil as in Example I only the margaric acid was replaced with octadecan amide; a third group was coated with an oil as in Example I only the margaric acid was replaced with octadecal alcohol and the fourth group was coated with an oil as in Example I except that there was no aliphatic additive. As in Example I the blades of the four groups were substantially rust free after the corrosion test and there was little change in the forces observed in the wool-felt cutting tests.

EXAMPLE IV

Carbon steel blades, having chromium coated edges as in Example I were dipped into a coating composition containing the following ingredients per liter: 30 gms. of cobalt chloride, 30 gms. of nickel chloride, 100 gms. of sodium citrate, 50 gms. of amonium chloride and 20 gms. of sodium hypophosphite. The blades were dipped into the coating solution which had a pH of 8 and a temperature of 100° C. for about 30 seconds, washed, dried, divided into four groups and the four groups were overcoated as set forth in Example III. After the corrosion test all of the groups of blades were substantially rust free and there was substantially little change in the wool-felt cutting forces for the chromium coated blades and those which were further coated with the nickel-cobalt-phosphorous coating.

EXAMPLE V

The process of Example I was repeated except that in the nickel-phosphorous electroless coating step a 2 and ⅛ inch stack of the blades were placed on a solid tongue magazine with a half inch of free space between the last blade and the clamping block. The magazine was immersed in distilled water and the blades were riffled using two fan-type water jets. The magazine was then placed in a plating bath and the blades were subjected to three passes by two fan-type solution jets which were capable of generating 46 p.s.i. pressure. In the first pass the fan jets travelled at 0.19 inches per sec. past the blades and in the second and third passes they travelled at 0.095 inches per second. The blades were washed and dried and then coated with an overcoatig as employed in Example I only stearic acid was used in place of the margaric acid. The results of the corrosion tests and wool-felt cutting tests were similar to those of Example I.

EXAMPLE VI

The process of Example V was repeated except that ultrasonic energy was used to riffle the blades. In carrying out the process a ¾ inch stack of the blades were placed on the magazine with a ⅛ inch gap between the last blade and the clamping block. The magazine was placed in the plating bath and moved at the rate 0.05 inches per second under an ultrasonic horn oscillating at 20 KHZ with a gap of 0.04 inches between the ends of the blades and the horn. The results of the corrosion and wool-felt cutting tests were similar to those obtained in Example V.

When blades which were treated according to the processes of this invention were shave tested they were comparable to stainless steel blades.

Having thus disclosed the invention, what is claimed is:

1. A process for improving the corrosion resistance and use-life of carbon steel razor blades, said process comprising coating the cutting edges of the blades with a chromium coating; immersing the blades in an electroless coating bath comprising a nickel-phosphorous, nickel-copper-phosphorous, cobalt-phosphorous or cobalt-nickel-phosphorous coating material to provide a coating of said coating material at least on the bodies of the blades, said chromium coating preventing said coating material from beading up on the cutting edges to an extent that would require resharpening of said cutting edges; and then overcoating the blades with a carboxy-functional silicone oil composition.

2. A process as defined in claim 1 wherein said chromium coating is between 50 to 600 Å in thickness and the electroless coating is between 1000 to 5000 Å on the bodies of the blades.

3. A process as defined in claim 1 wherein said carboxy-functional silicone oil is a carboxy-functional polydimethylsiloxane.

4. A process as defined in claim 2 wherein said carboxy-functional silicone oil is a carboxy-functional polydimethylsiloxane.

5. A process as defined in claim 1 wherein said carboxy-functional silicone oil composition comprises a long chain aliphatic compound, said compound being an acid, alcohol, amide, or mixtures thereof.

6. A process as defined in claim 2 wherein said carboxy-functional silicone oil composition comprises a long chain aliphatic compound, said compound being an acid, alcohol, amide or mixtures thereof.

7. A process as defined in claim 5 wherein the long chain aliphatic compound is present in amounts of 1 to 10% by weight of said silicone oil composition.

8. A process as defined in claim 6 wherein the long chain aliphatic compound is present in amounts of 1 to 10% by weight of said silicone oil composition.

9. Carbon steel razor blades having improved corrosion resistance and use-life, said blades being produced by coating the edges with a 50 to 600Å coating of chromium; immersing the blades in an electroless coating bath comprising nickel-phosphorous, nickel-copper-phosphorous, cobalt-phosphorous or cobalt-nickel-phosphorous coating materials to provide a 1000 to 5000Å coating of said coating on the bodies of the blades, said chromium coating keeping the thickness of said coating materials on the cutting edges to less than 100Å whereby resharpening of the edges is not required; and then overcoating the blades with a carboxy-functional silicone oil composition.

10. Blades as defined in claim 9 wherein said carboxy-functional silicone oil composition comprises a long chain aliphatic compound, said compound being an acid, alcohol, amide or mixtures thereof.

* * * * *